US008575912B1

(12) United States Patent
Tung

(10) Patent No.: US 8,575,912 B1
(45) Date of Patent: Nov. 5, 2013

(54) CIRCUIT FOR GENERATING A DUAL-MODE PTAT CURRENT

(75) Inventor: Ming-Sheng Tung, Hsinchu (TW)

(73) Assignee: Elite Semiconductor Memory Technology Inc., Hsinchu (TW)

( * ) Notice: Subject to any disclaimer, the term of this patent is extended or adjusted under 35 U.S.C. 154(b) by 68 days.

(21) Appl. No.: 13/476,520

(22) Filed: May 21, 2012

(51) Int. Cl.
*G05F 3/16* (2006.01)

(52) U.S. Cl.
USPC ..... 323/313; 323/907

(58) Field of Classification Search
USPC ..... 323/312–315, 907
See application file for complete search history.

(56) References Cited

U.S. PATENT DOCUMENTS 4,490,669 A * 12/1984 Wilhelm ..... 323/313
4,906,859 A * 3/1990 Kobayashi et al. ..... 307/17
5,013,934 A * 5/1991 Hobrecht et al. ..... 327/527
5,063,342 A * 11/1991 Hughes et al. ..... 323/315
5,512,815 A * 4/1996 Schrader ..... 323/315
5,666,046 A * 9/1997 Mietus ..... 323/313
6,894,473 B1 * 5/2005 Le et al. ..... 323/314
6,922,045 B2 7/2005 Self et al.
7,161,340 B2 * 1/2007 Chiu ..... 323/316
7,253,597 B2 * 8/2007 Brokaw ..... 323/314
7,728,575 B1 6/2010 Ozalevli et al.
7,775,710 B2 8/2010 Mukherjee

* cited by examiner

*Primary Examiner* — Adolf Berhane
(74) *Attorney, Agent, or Firm* — WPAT, P.C.; Anthony King

(57) ABSTRACT

The present invention discloses a circuit for generating a dual-mode proportional to absolute temperature (PTAT) current. The circuit includes a voltage stabilizing circuit to provide a voltage reference, and a load current control circuit comprising a first transistor to provide a first load current based on the voltage reference, a second transistor to provide a second load current based on the voltage reference, a first switch to control whether to allow the first load current to flow therethrough in response to different predetermined temperatures, and a second switch to control whether to allow the second load current to flow therethrough in response to the different predetermined temperatures. A resultant current resulting from at least one of the first load current or the second load current has different current magnitudes at the different predetermined temperatures.

20 Claims, 3 Drawing Sheets

CIRCUIT FOR GENERATING A DUAL-MODE PTAT CURRENT

BACKGROUND OF THE INVENTION

1. Technical Field

The present invention generally relates to a circuit for generating a proportional to absolute temperature (PTAT) current and, more particularly, to a circuit for generating a dual-mode PTAT current based on a voltage reference.

2. Background

Bandgap voltage references are used in a variety of integrated circuits, electronic devices and electronic systems that require a stable voltage reference over a range of temperatures and process variations. For example, many data acquisition systems, voltage regulators and measurement devices utilize bandgap voltage reference circuits to provide a stable voltage reference to serve as a comparison basis for other supply and/or input voltages. Although traditional bandgap voltage reference circuits may generate bandgap voltages exhibiting little variation over a nominal range of operating temperatures, higher-order device characteristics, such as device voltages and currents that vary nonlinearly with temperature, can cause the generated bandgap voltage to vary substantially at temperatures outside the nominal temperature range.

In the traditional design, an oscillator generates a frequency independent of temperature, which means that even the temperature changes, the oscillator generates a constant frequency. If it is required to generate two frequencies at different temperatures, it may be needed to generate two control currents dependent of temperature in order to control an oscillator to generate the frequencies.

Some bandgap voltage reference circuits, in an attempt to address the above-mentioned issue, have been developed. For example, U.S. Pat. No. 7,728,575 disclosed an apparatus including a low temperature correction circuit and a high current correction circuit for higher-order correction of bandgap voltage references. However, the apparatus may be complex and not cost efficient. Moreover, U.S. Pat. No. 6,922,045 disclosed a current driver circuit to generate temperature compensated currents. However, the architecture may still be complex and not flexible.

SUMMARY

Embodiments of the present invention may provide a circuit for generating a current based on a voltage reference. The circuit includes a voltage stabilizing circuit to provide a voltage reference, and a load current control circuit comprising a first transistor to provide a first load current based on the voltage reference, a second transistor to provide a second load current based on the voltage reference, a first switch to control whether to allow the first load current to flow therethrough in response to different predetermined temperatures, and a second switch to control whether to allow the second load current to flow therethrough in response to the different predetermined temperatures. A resultant current resulting from at least one of the first load current or the second load current has different current magnitudes at the different predetermined temperatures.

Some embodiments of the present invention may further provide a circuit for generating a current based on a voltage reference. The circuit includes a first transistor to provide a first load current, a second transistor to provide a second load current, a first switch to control the first load current, wherein the first switch is responsive to at least one of a first predetermined temperature or a second predetermined temperature, and a second switch to control the second load current, wherein the second switch is responsive to at least one of the first predetermined temperature or the second predetermined temperature. A resultant current resulting from at least one of the first load current or the second load current has a first current magnitude at the first predetermined temperature and a second current magnitude at the second predetermined temperature.

DETAILED DESCRIPTION

Figure 1:
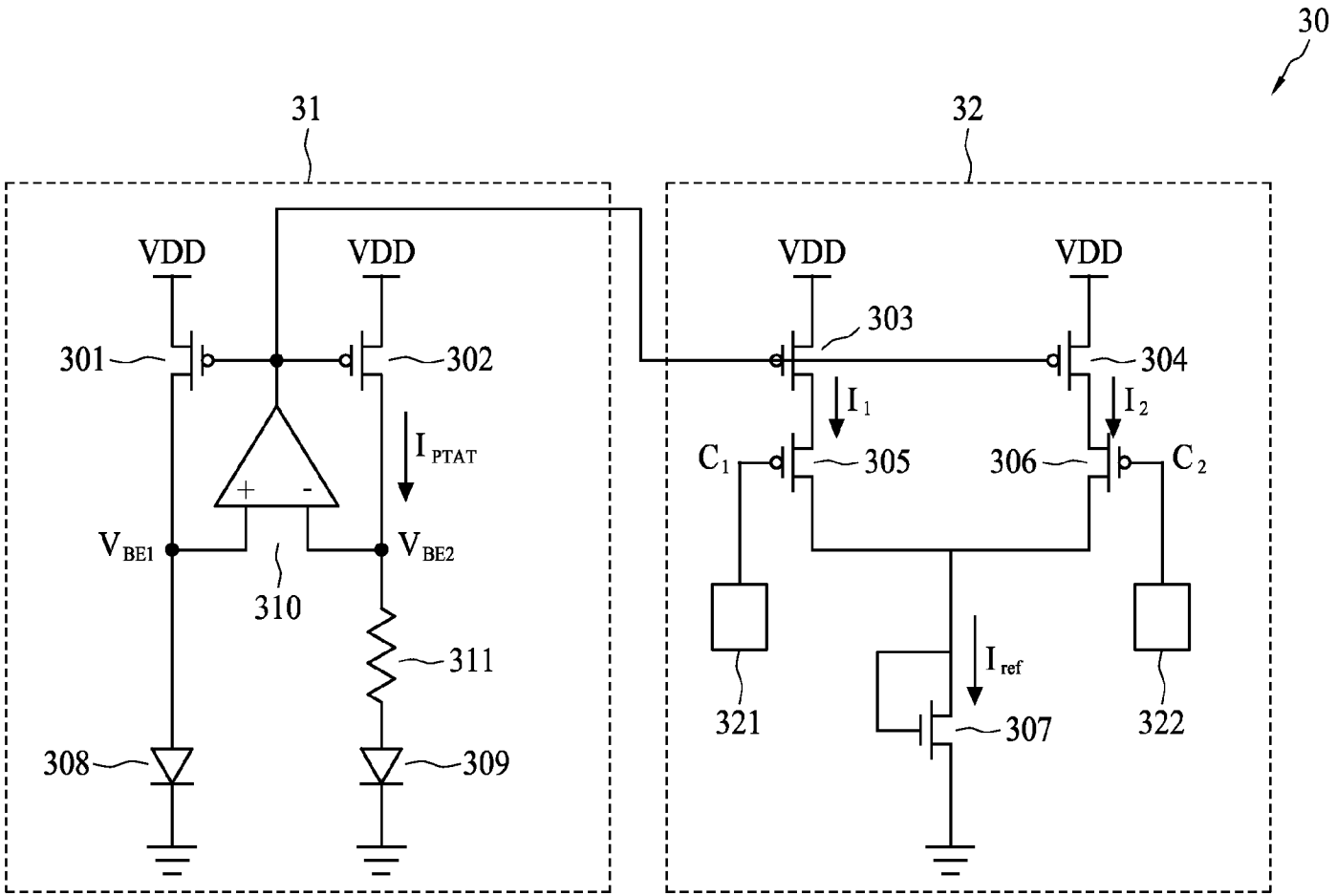
FIG. 1 shows a circuit for generating a dual-mode PTAT current according to one embodiment of the present invention.

FIG. 1 shows a circuit 30 for generating a dual-mode proportional to absolute temperature (PTAT) current according to one embodiment of the present invention. Referring to FIG. 1, the circuit 30 includes a voltage stabilizing circuit 31 and a load current control circuit 32. The voltage stabilizing circuit 31 may serve as a bandgap voltage circuit for generating a voltage reference. The load current control circuit 32 may, based on the voltage reference, generate a dual-mode PTAT current.

The voltage stabilizing circuit 31 includes a first metal-oxide-semiconductor (MOS) transistor 301, a second MOS transistor 302, a first semiconductor device 308, a second semiconductor device 309, a resistor 311 and a differential amplifier 310. The first MOS transistor 301 provides a resistance as a load in a feedback path to an input (for example, a non-inverting input) of the differential amplifier 310. Furthermore, the second MOS transistor 302 provides a resistance as a load in another feedback path to another input (for example, an inverting input) of the differential amplifier 310.

The resistor 311 limits a PTAT current $I_{PTAT}$ from the second transistor 302 and has a positive temperature coefficient, which means that the impedance of the resistor 311 increases as the temperature increases, and vice versa.

The first semiconductor device 308 may include a diode as in the present embodiment or a transistor in another embodiment. The first semiconductor device 308 has a negative temperature coefficient, which means that the impedance of the first semiconductor device 308 decreases as the temperature increases, and vice versa. The first semiconductor device 308 provides a voltage $V_{BE1}$ at the one input of the differential amplifier 310. Similarly, the second semiconductor device 309 also has a negative temperature coefficient and provides, in conjunction with the resistor 311, a voltage $V_{BE2}$ at the other input of the differential amplifier 310.

Because the resistor 311 has a positive temperature coefficient and the first and second semiconductor devices 308 and 309 have negative temperature coefficients, temperature effects can be alleviated or even cancelled by the resistor 311 and the semiconductor devices 308 and 309. Therefore, an output voltage of the voltage stabilizing circuit 31 may not be affected by temperature variation, which means that the output voltage is temperature independent.

The load current control circuit 32, based on the output voltage at an output of the voltage stabilizing circuit 31, provides a load current $I_{ref}$ as an output load. Furthermore, the load current control circuit 32 includes a first MOS transistor 303, a second MOS transistor 304, a third MOS transistor 305, a fourth MOS transistor 306 and a fifth MOS transistor 307.

The first MOS transistor 303, including a gate terminal (not numbered) coupled with the output of the voltage stabilizing circuit 31, provides a first load current $I_1$ flowing toward the third MOS transistor 305. The second MOS transistor 304, including a gate terminal (not numbered) coupled with the output of the voltage stabilizing circuit 31, provides a second load current $I_2$ flowing toward the fourth MOS transistor 306. The first load current $I_1$ and the second load current $I_2$ together flow through the fifth MOS transistor 307, resulting in the load current $I_{ref}$.

The third MOS transistor 305 serves as a first switch for the first load current $I_1$ while the fourth MOS transistor 306 serves as a second switch for the second load current $I_2$. A gate terminal $C_1$ of the third MOS transistor 305 is connected to a first temperature sensor 321. The third MOS transistor 305 initially is set at an "on" state. Upon reaching a first predetermined temperature, the first temperature sensor 321 provides a disable signal to the gate terminal $C_1$ to turn off the third MOS transistor 305, disallowing the first load current $I_1$ to flow therethrough.

Moreover, a gate terminal $C_2$ of the fourth MOS transistor 306 is connected to a second temperature sensor 322. The fourth MOS transistor 306 initially is set at an "off" state. Upon reaching the first predetermined temperature, in response to which the third MOS transistor 305 is turned off, the second temperature sensor 322 provides an enable signal to the gate terminal $C_2$ to turn on the fourth MOS transistor 306, allowing the second load current $I_2$ to flow therethrough. Subsequently, upon reaching a second predetermined temperature, which is greater than the first predetermined temperature, the first temperature sensor 321 provides an enable signal to the gate terminal $C_1$ to turn on the third MOS transistor 305, allowing the first load current $I_1$ to flow therethrough.

Although in the present embodiment, two temperature sensors 321 and 322 are provided in the circuit 30, in other embodiments, only a single temperature sensor may be used for temperature detection.

Furthermore, in the present embodiment, two load currents $I_1$ and $I_2$ and the associated two switches 305 and 306 are provided in the circuit 30 to generate the load current $I_{ref}$, which increases from an initial magnitude (MOS 305 on and MOS 306 off) to a first magnitude (MOS 305 off and MOS 306 on) in response to the first predetermined temperature, and increases from the first magnitude to a second magnitude (MOS 305 on and MOS 306 on) in response to the second predetermined temperature. Accordingly, the load current $I_{ref}$ may enjoy a dual-mode application with the first current magnitude and the second current magnitude.

In other embodiments, however, three or more load currents and associated three or more switches may be provided in a circuit to generate a resultant load current, which has three or more current magnitudes in response to three or more predetermined temperatures. Accordingly, such a circuit may enjoy a triple-mode or multi-mode application.

Figure 2:
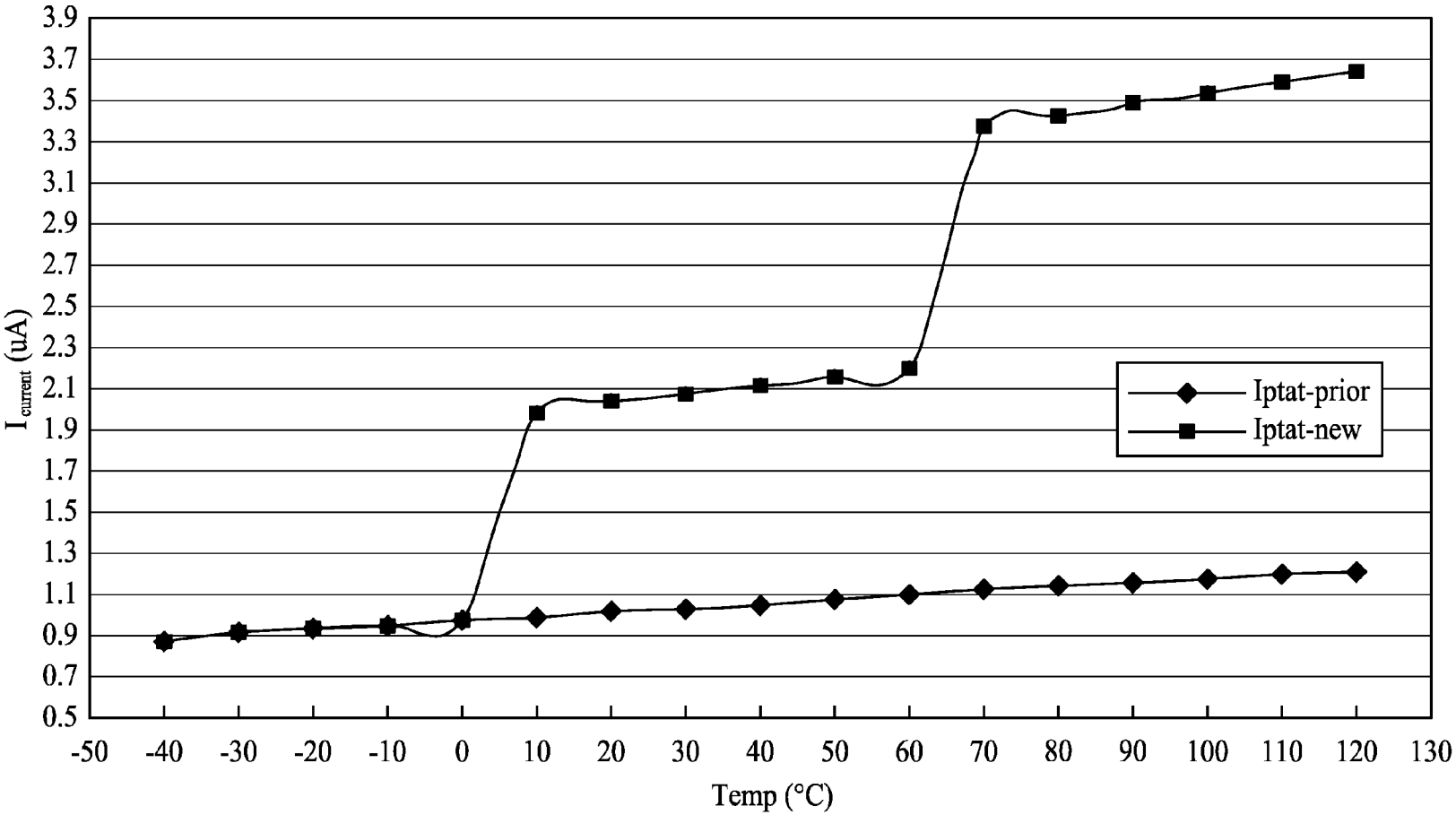
FIG. 2 is a diagram illustrating a dual-mode PTAT current relative to temperature according to one embodiment of the present invention.

FIG. 2 is a diagram illustrating a dual-mode PTAT current relative to temperature according to one embodiment of the present invention. Referring to FIG. 2, the curve marked with diamonds represents a conventional bandgap circuit that provides a stable voltage but, however, a small current, which may limit its application. As a comparison, the curve marked with squares represents a circuit in accordance with an embodiment of the present invention, which provides not only a temperature independent voltage reference but also a current with significant magnitudes for a dual-mode application. FIG. 2 shows two significant changes in the square-marked current, which are caused by switching on/off the third MOS transistor 305 and the fourth MOS transistor 306, respectively, by the first and second temperature sensors 321 and 322 at the first and second predetermined temperatures. In one embodiment, the first predetermined temperature may be approximately 5° C. and the second predetermined temperature may be approximately 65° C.

Figure 3:
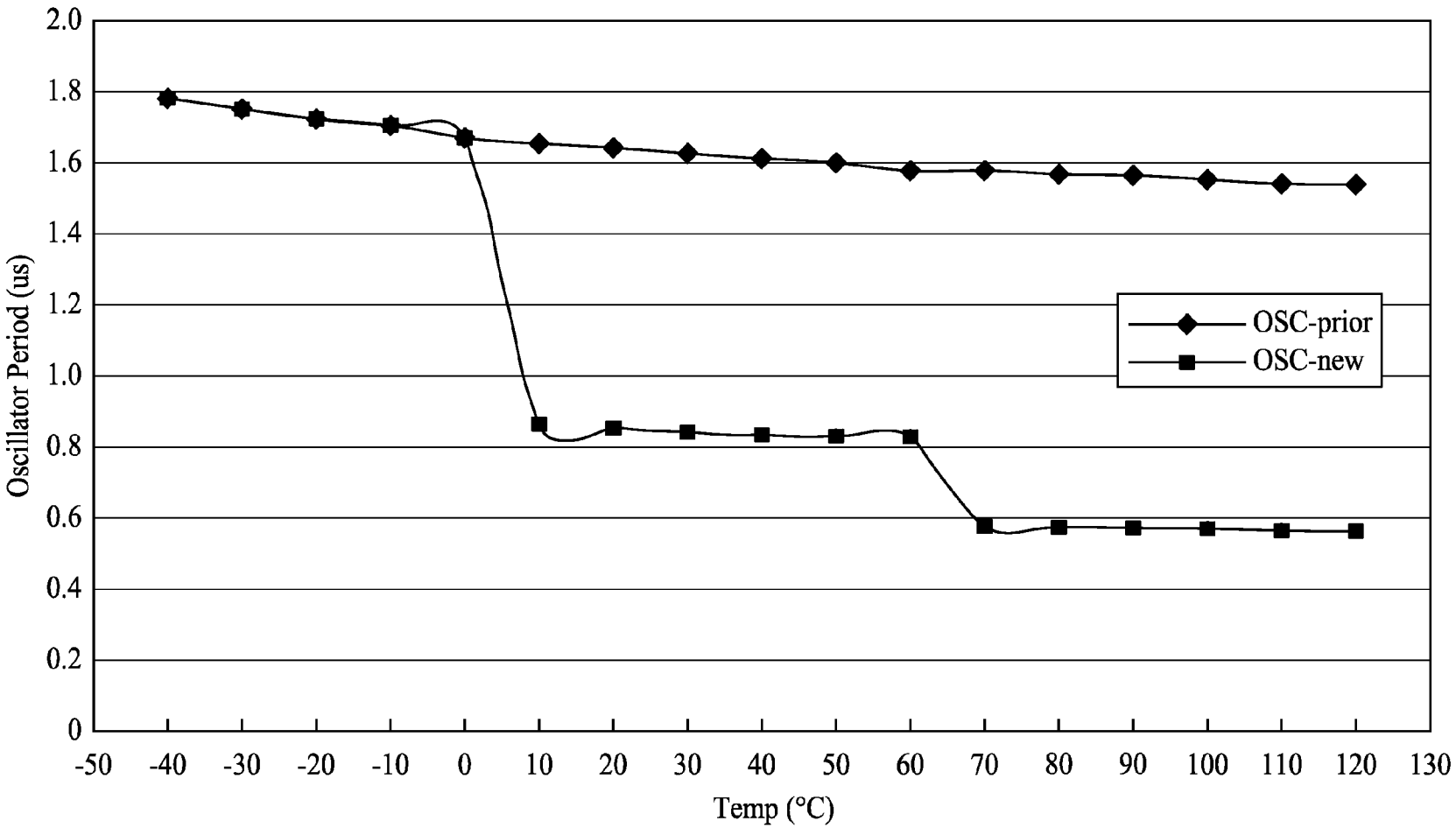
FIG. 3 is a diagram illustrating oscillator period relative to temperature according to one embodiment of the present invention.

FIG. 3 is a diagram illustrating oscillator period relative to temperature according to one embodiment of the present invention. The load current $I_{ref}$ may be provided to a current-controlled oscillator. When the current $I_{ref}$ changes, the frequency and period of the oscillator change. Referring to FIG. 3, the curve marked with diamonds represents the oscillator period of a current-controlled oscillator that receives a current from a conventional bandgap circuit. As a comparison, the curve marked with squares represents the oscillator period of a current-controlled oscillator that receives a current from a circuit in accordance with an embodiment of the present invention. The square-marked curve indicates two significant changes at the predetermined temperatures of approximately 5° C. and 65° C.

Although the present invention and its advantages have been described in detail, it should be understood that various changes, substitutions and alterations can be made herein without departing from the spirit and scope of the invention as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A circuit for generating a current based on a voltage reference, the circuit comprising:

a voltage stabilizing circuit to provide a voltage reference; and a load current control circuit comprising:

a first transistor to provide a first load current based on the voltage reference;

a second transistor to provide a second load current based on the voltage reference;

a first switch to control whether to allow the first load current to flow therethrough in response to different predetermined temperatures; and a second switch to control whether to allow the second load current to flow therethrough in response to the different predetermined temperatures, wherein a resultant current resulting from at least one of the first load current or the second load current has different current magnitudes at the different predetermined temperatures.

2. The circuit of claim 1, wherein each of the first transistor and the second transistor includes a gate terminal coupled with an output of the voltage stabilizing circuit.

3. The circuit of claim 1, wherein the voltage reference is a temperature independent voltage reference.

4. The circuit of claim 1 further comprising a first temperature sensor coupled with the first switch, and a second temperature sensor coupled with the second switch.

5. The circuit of claim 4, wherein the first switch is configured to be initially set at an "on" state, and switch to an "off" state in response to a first predetermined temperature.

6. The circuit of claim 5, wherein the second switch is configured to be initially set at an "off" state, and switch to an "on" state in response to the first predetermined temperature.

7. The circuit of claim 6, wherein the resultant current increases from an initial magnitude to a first magnitude in response to the first predetermined temperature.

8. The circuit of claim 7, wherein the first switch is configured to switch to the "on" state in response to a second predetermined temperature, the second predetermined temperature being greater than the first predetermined temperature.

9. The circuit of claim 8, wherein the resultant current increases from the first magnitude to a second magnitude in response to the second predetermined temperature, the second magnitude being greater than the first magnitude.

10. The circuit of claim 1 further comprising an oscillator to receive the resultant current.

11. A circuit for generating a current based on a voltage reference, the circuit comprising:

a first transistor to provide a first load current;

a second transistor to provide a second load current;

a first switch to control the first load current, the first switch being responsive to at least one of a first predetermined temperature or a second predetermined temperature; and a second switch to control the second load current, the second switch being responsive to at least one of the first predetermined temperature or the second predetermined temperature wherein a resultant current resulting from at least one of the first load current or the second load current has a first current magnitude at the first predetermined temperature and a second current magnitude at the second predetermined temperature.

12. The circuit of claim 11, wherein each of the first transistor and the second transistor includes a gate terminal to receive the voltage reference.

13. The circuit of claim 11, wherein the voltage reference is a temperature independent voltage reference.

14. The circuit of claim 11 further comprising a first temperature sensor coupled with the first switch, and a second temperature sensor coupled with the second switch.

15. The circuit of claim 14, wherein the first switch is configured to be initially set at an "on" state, and switch to an "off" state in response to the first predetermined temperature.

16. The circuit of claim 15, wherein the second switch is configured to be initially set at an "off" state, and switch to an "on" state in response to the first predetermined temperature.

17. The circuit of claim 16, wherein the resultant current increases from an initial magnitude to the first magnitude in response to the first predetermined temperature.

18. The circuit of claim 17, wherein the first switch is configured to switch to the "on" state in response to the second predetermined temperature, the second predetermined temperature being greater than the first predetermined temperature.

19. The circuit of claim 18, wherein the resultant current increases from the first magnitude to the second magnitude in response to the second predetermined temperature, the second magnitude being greater than the first magnitude.

20. The circuit of claim 11 further comprising an oscillator to receive the resultant current.

* * * * *